US011850194B1

(12) United States Patent
Hector et al.

(10) Patent No.: US 11,850,194 B1
(45) Date of Patent: Dec. 26, 2023

(54) AUTOMATIC BRAKING DEVICE FOR A MANUALLY PROPELLED VEHICLE

(71) Applicants: Melvin G. Hector, Tucson, AZ (US); John Ryan Hector, Tucson, AZ (US)

(72) Inventors: Melvin G. Hector, Tucson, AZ (US); John Ryan Hector, Tucson, AZ (US)

( * ) Notice: Subject to any disclaimer, the term of this patent is extended or adjusted under 35 U.S.C. 154(b) by 0 days.

(21) Appl. No.: 18/215,596

(22) Filed: Jun. 28, 2023

Related U.S. Application Data

(60) Provisional application No. 63/388,026, filed on Jul. 11, 2022.

(51) Int. Cl.
*A61G 5/10* (2006.01)

(52) U.S. Cl.
CPC ..... *A61G 5/1018* (2013.01); *A61G 5/1086* (2016.11)

(58) Field of Classification Search
CPC ..... A61G 5/1018; A61G 5/1086
USPC ..... 188/2 F, 29, 74; 280/242.1, 250.1
See application file for complete search history.

(56) References Cited

U.S. PATENT DOCUMENTS 3,556,260 A * 1/1971 Meyer ..... A61G 5/1035 188/74
5,401,044 A * 3/1995 Galumbeck ..... A61G 5/128 188/2 F
2021/0128380 A1* 5/2021 Steiner ..... A61G 5/101

* cited by examiner

*Primary Examiner* — Christopher P Schwartz
(74) *Attorney, Agent, or Firm* — Quarles & Brady LLP; Yakov S. Sidorin

(57) ABSTRACT

An automatic braking device for a manually propelled vehicle such as a standard wheelchair. The device is configured to substantially lock the wheel thus preventing the vehicle from rolling backwards when the occupant—while attempting to exit the vehicle—for example forgets to lock a standard brake of the vehicle, thereby preventing the sometimes-serious fall of the occupant. The impeding of the backward rotation of the wheel and/or substantially preventing of the wheel from so rotating is carried out with the use of a flexible leg of the brake pad, repositionable with respect to the stationary plate of the brake pad during the wheel rotation. The device is cooperated with the wheel of the vehicle to not interfere with the intentional movement of the wheelchair in any direction, nor does it interfere with the typical locking mechanism of the standard wheelchair.

23 Claims, 11 Drawing Sheets

AUTOMATIC BRAKING DEVICE FOR A MANUALLY PROPELLED VEHICLE

CROSS-REFERENCE TO RELATED APPLICATIONS

This US Patent Application claims priority from and benefit of the U.S. Provisional Patent Application No. 63/388,026 filed on Jul. 11, 2022, the disclosure of which is incorporated herewith by reference.

TECHNICAL FIELD

The present invention relates to an automatic braking device configured to prevent unintended rollback of a manually propelled vehicle (such as a wheelchair, in one instance) as an occupant of the vehicle exits or as the vehicle remains unattended and, more particularly, to a vehicle wheel stopper at least reducing and preferably ceasing the backward rotation of the wheel without human control when standard brakes with which such vehicle is equipped have not been activated.

SUMMARY OF THE INVENTION

Embodiments of the invention provide an article of manufacture that includes at least an automatic braking device and, in some implementations, a manually-propelled vehicle structurally and operationally reversibly integrated with such automatic device. The automatic breaking device includes at least a housing structure and a brake pad contained in the housing structure. The housing structure has a front housing shell and a back housing shell configured to be reversibly assembleable together to define a space of the housing structure, and identifies a top portion of the housing structure and a bottom opening that is formed between the front housing shell and the back housing shell opposite the top portion. The brake pad defines a plane of the brake pad and includes a head portion of the brake pad and a brake leg that extends from the head portion. The head portion of the brake pad is configured to be reversibly affixed inside the space at the top portion to the housing structure with the brake leg extending throughout the space towards the bottom opening. Notably, and whether the article of manufacture does or does not include a vehicle in combination with the braking device, such article is devoid of a part controlling a movement of the brake pad in a motorized fashion, and/or devoid of a brake rotor, and/or devoid of a component configured to reposition the brake pad along a radius of the wheel of the vehicle after the device has been cooperated with the wheel. Substantially in every implementation, the housing structure may be dimensioned to permit repositioning of the brake leg in the plane of the brake pad between side walls of the housing structure and/or spatially limit said repositioning at at least a portion of a side wall of the side walls of the housing structure; and/or, when corresponding dimensional extents of the front housing shell and the back housing shell are substantially equal to one another, the housing structure may be dimensioned to define in an assembled state a volume substantially enclosed by the front and back housing shells (such that access to such volume is formed through the bottom opening). Alternatively or in addition, and substantially in every implementation, the article of manufacture may be configured to satisfy at least one of the following conditions: a) the head portion of the brake pad is equipped with an opening throughout the head portion and the housing structure contains or is complemented with a shaft or axle that is fitted into and/or through the opening when the brake pad and the housing structure are assembled together; b) this shaft or axle is integrated with a housing shell of the front and back housing shells, c) such opening throughout the head portion of the brake pad is not a substantially cylindrical opening and has an internal surface, while the article of manufacture additionally includes a washer having an outer surface of the washer that is substantially dimensionally complementary to the internal surface of the opening throughout the head portion of the brake pad; d) the internal surface of the opening throughout the head portion of the brake pad is dimensioned to form at least one dihedral angle; e) the washer includes a washer portion containing such outer surface of the washer, and the washer portion is dimensioned to be received within this opening throughout the head portion of the brake pad to substantially prevent mutual rotation between the brake pad and the washer about the axis of this opening when the washer portion is inserted in this opening.

Generally, the active braking device is configured such as to have an end of the brake leg to remain in frictional contact with a wheel of the manually-propelled vehicle (with which the active braking device is configured to be juxtaposed) while not preventing a rotation of the wheel when the wheel is rotated in a forward direction, and/or the braking device is configured to have the brake leg to at least compress such as to change a shape of the brake leg and increase frictional contact between an end of the brake leg and the wheel when the wheel is rotated in a backward direction, and/or the braking device is configured to have the brake leg reversibly flex in the backward direction when a momentum of rotation of the wheel in the backward direction exceeds a threshold value while, at the same time, to have the brake leg flex in the forward direction when a direction of the rotation of the wheel in changed from the backward direction to the forward direction.

Embodiments of the invention additionally provide a method that includes at least the following steps: (i) cooperating an automatic braking device with a wheel of a manually- propelled vehicle such that an outer surface of the brake leg remains in frictional contact with an outer portion of the wheel regardless of whether the wheel is rotated in a forward direction or in a backward direction; (ii) keeping a level of friction between the brake leg and the outer portion of the wheel below a level of static friction by having the brake leg repositioned in the forward direction (when the wheel is rotated in the forward direction); and (iii) necessarily increasing the level of friction by having the brake leg repositioned in the backward direction (when the wheel is rotated in backward direction). Notably, the step of increasing the level of friction may include increasing said level of friction to the level of static friction, thereby substantially preventing a rotation of the wheel in the backward direction (and/or stopping such rotation of the wheel). As is well recognized in related art, static friction is a force that keep an object at rest on a surface (~the frictional force between two surfaces that re not moving related to each other, opposing motion in an object at rest). Alternatively or in addition, and substantially in every implementation, the method may include a step of reversibly flexing the brake leg in the backward direction while not preventing the wheel from continued rotation in the backward direction (this step being implemented when the wheel is rotated in the backward direction with a momentum exceeding a threshold momentum). Embodiments of the method are implemented in such a fashion as to ensure that an ability of the occupant to operate the manually-propelled vehicle is not obstructed by the automatic braking device; and/or such as to ensure that the ability of the occupant to remove and/or replace an armrest of the wheelchair required for the occupant's rising from and/or egressing the vehicle is not obstructed by the automatic device.

BRIEF DESCRIPTION OF THE DRAWINGS

The invention will be more fully understood by referring to the following Detailed Description of Specific Embodiments in conjunction with the Drawings, of which.

Figure 1:
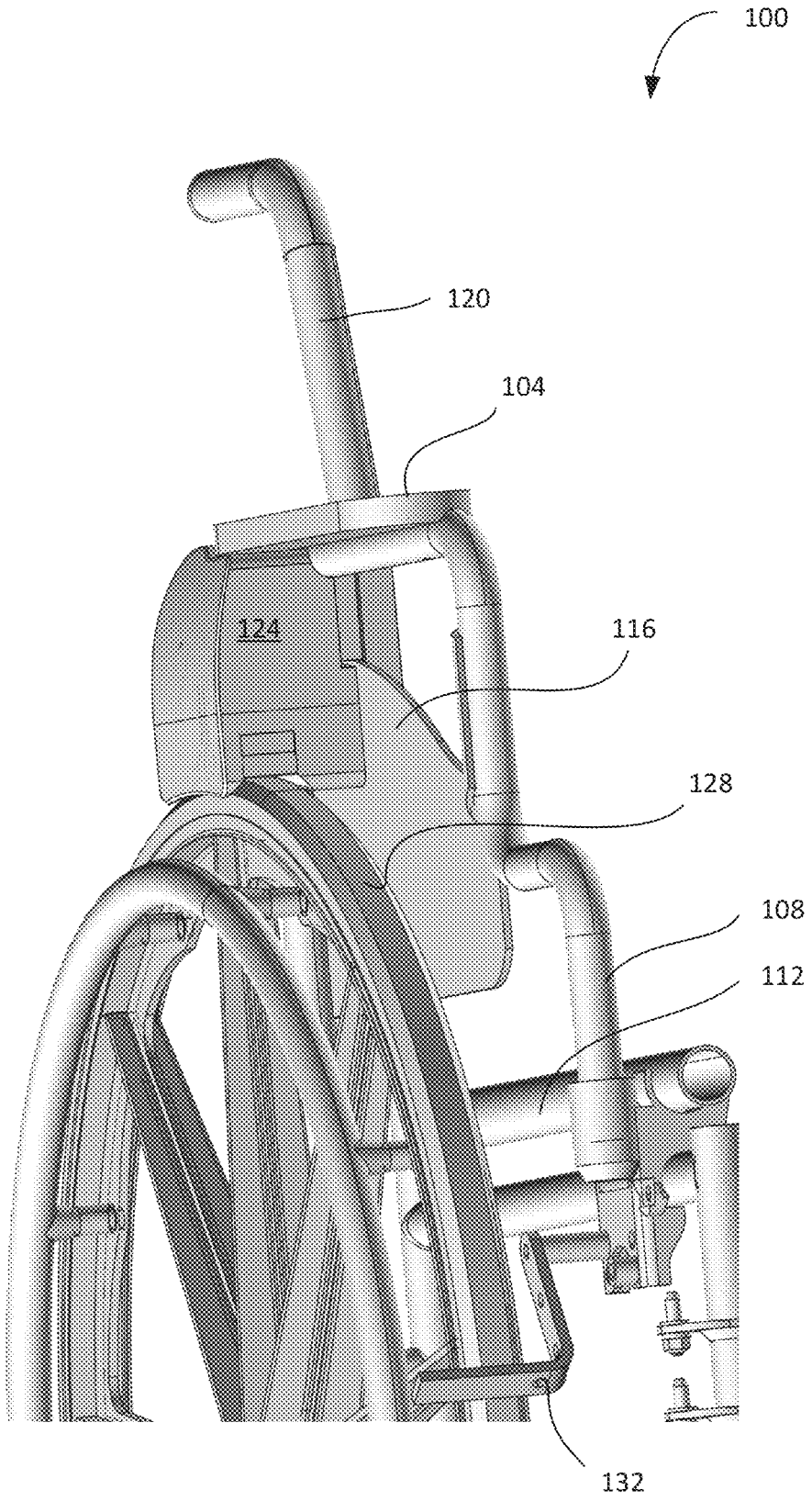
FIG. 1 is a schematic three-dimensional representation of a portion of a manually propelled vehicle cooperated with an embodiment of the braking mechanism system (interchangeably referred herein as the automatic braking device or the braking device) that is configured according to the idea of the invention. As shown, the embodiment of the automatic braking device is juxtaposed with the rights side/right wheel/right armrest/right armrest partition of a standard manual wheelchair. (It is understood that it may be preferred to have another unit of the braking mechanism system be applied to/cooperated with another wheel of the vehicle.)

Generally, the sizes and relative scales of elements in Drawings may be set to be different from actual ones to appropriately facilitate simplicity, clarity, and understanding of the Drawings. For the same reason, not all elements present in one Drawing may necessarily be shown in another. Drawings are generally not to scale.

DETAILED DESCRIPTION

Implementations of the idea of the present invention are configured as a braking mechanism that, in operating, automatically (that is, substantially without the intervention from the user) locks at least one (and preferably—each of) large wheels of a wheelchair (and, generally, a manually-propelled vehicle including, for example, a wheeled walker such as rollator) against the relatively modest movement backwards when the wheelchair user or occupant attempts to exit the wheelchair (and, especially, when the wheelchair occupant has forgotten or is incapable of remembering to lock the standard wheelchair brakes to prevent backward movement). The occupant, therefore, can safely move from the wheelchair to his or her bed, another chair, a toilet seat, or a seat in an automobile or other vehicle without having their wheelchair roll away from them, and without the added risk of a subsequent and often injurious fall.

In a preferred implementation of this feature, discussed below embodiment automatic braking system(s) is(are) added to at least one—or, preferably, each—side of the wheelchair or manually propelled vehicle that has a somewhat flexible (generally but optionally elastic) brake pad within it. The brake pad has a surface that, after the system is operably cooperated with the wheelchair, rides in contact with the wheel substantially without hindrance, as long as the wheel is moving and/or rotating forward. As soon as the wheelchair wheel is directed by the occupant to move in reverse, resistance is automatically immediately applied by an end portion of the brake pad to hinder that motion. The applied frictional resistance is more than sufficient to keep an unoccupied wheelchair from rolling backwards, but can be overcome by even modest effort if the wheelchair occupant simply wishes to move backwards while they are still in the wheelchair, by pushing the wheelchair wheel backward as they normally might. As soon as the occupant moves the wheelchair forward again, the flexible brake pad of the automatic braking system is moved (reloads) to its original position and is, therefore, positioned to again prevent the wheelchair from moving backwards again, if unoccupied.

Accordingly, a problem of operation of manually-propelled vehicles manifesting in an unintentional backward motion and/or roll-back of the vehicle (that is caused by an attempt of the user to exit the vehicle while forgetting to apply a standard vehicle brake and that often results in a fall of the user who assumes that the vehicle is still behind him) is solved by providing an automatic braking device which, when cooperated with a wheel of the vehicle, prevents the vehicle from rolling back while at the same time not interfering with intentional movement of the vehicle in either forward or backward direction.

Unless expressly defined otherwise, the term automatic, as used in reference to a device or a process, implies that such device or process works or operated by itself and with no direct human intention or control. The term manually propelled vehicle, as used here, refers to and covers a wheelchair (employed by a user in case of experiencing difficulties with walking due to injury, illness, or disability, for example), a pram, or another vehicle-like contraption propelled by the weight or force of one or more persons skating, sliding or riding on the vehicle or by one or more other persons pulling or pushing the vehicle. A forward direction as used herein is a term defined to denote and refer to a direction of repositioning of the manually propelled vehicle moving forward and/or a direction of rotation of a wheel of such vehicle when the vehicle is moving forward; a backward or reversed direction is a direction opposite to the forward direction.

FIG. 1 provides a general setting by schematically illustrating a portion of a manually-propelled vehicle (in this case—a portion of a standard wheelchair) equipped with an embodiment of the automatic braking device (which can be interchangeably referred to herein as an anti-rollback device or a braking mechanism system or simply as a braking device) structured according to an idea of the invention. The so-equipped vehicle 100 has standard features such as, for example, a wheelchair armrest 104, anterior wheelchair rail 108, wheelchair seat rail 112, armrest partition 116, and a hand-rail 120, among other standard structural features. The embodiment 124 of the braking device is shown to be removably cooperated with the right side of the vehicle 100 and is dimensioned to precisely fit a given type of the vehicle and judiciously engage the right wheel 128 (as shown—with an outer rim of it) while, at the same time, not interfere with or otherwise disturb any of the standard features of the vehicle 100. In at least one implementation the embodiment 124 is structured such that at least any of the features 104, 116, 120 can be used as the basis for firmly attaching an embodiment of the installed anti-rollback device to a chosen wheelchair or a manually propelled vehicle, either temporarily (that is, removably) or permanently (that is, irremovably). In one non-limiting example, such wheelchair may be the most commonly used wheelchair Invacare Tracer EX 2 (see, for example, invacare.com).

The numeral 132 identifies a standard braking mechanism with which a conventional standard wheelchair is equipped in related art, and which requires the input of the user of or attendant to the chair 100 to be activated. Such standard mechanism is often configured as a bracket that is, in operation, pushed against the wheel (the tire of the wheel) until it comes into a reversible frictional contact with the wheel to effectively reduce the ability of the wheel to rotate and/or substantially completely lock the wheel until the user lifts the bracket to free the wheel.

Figure 2A:
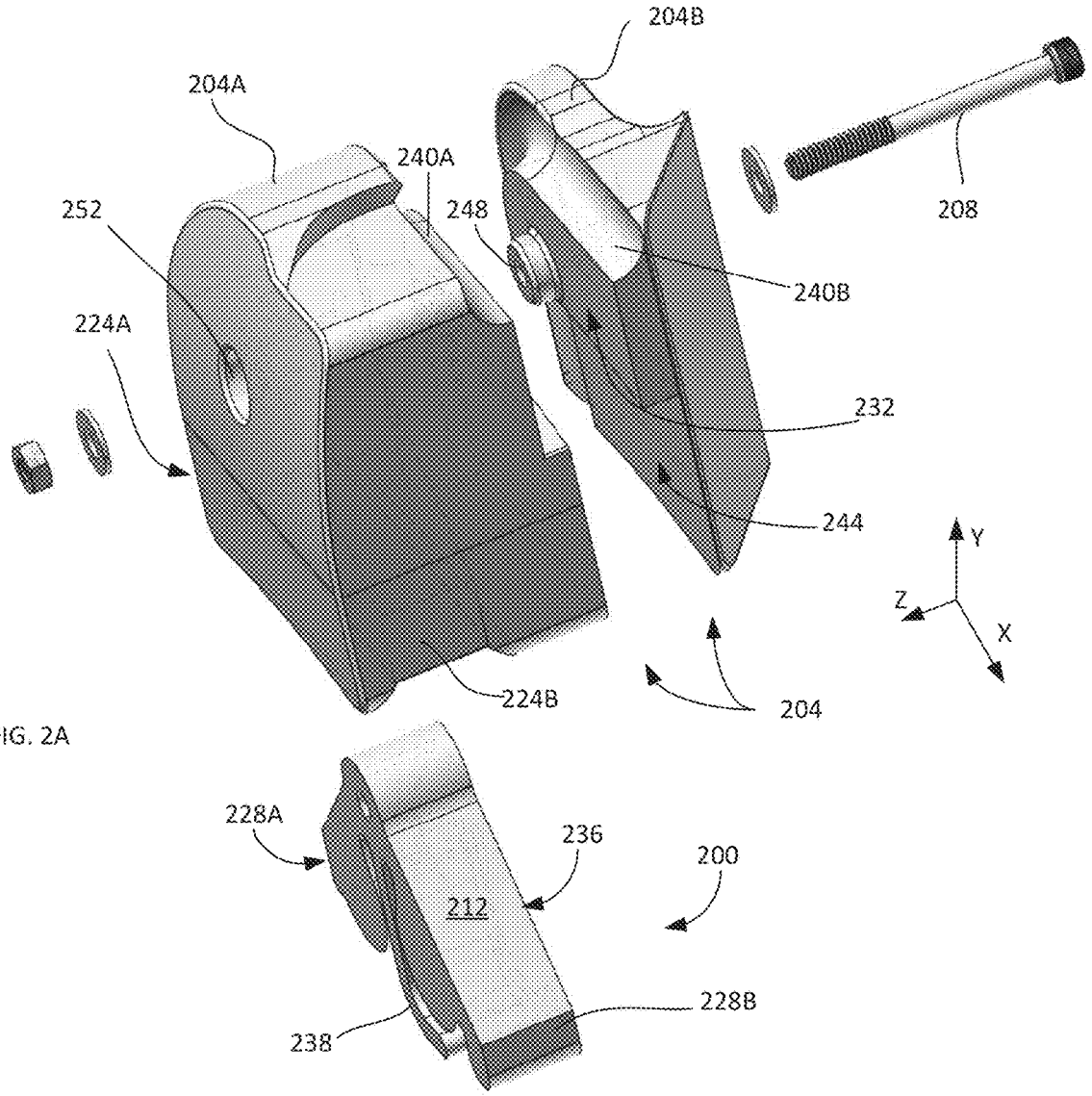
FIG. 2A is an exploded view of an embodiment of a braking mechanism assembly showing its constituent parts, not necessarily in order, including an outer portion of the housing, a forward-facing flexible brake pad, an inner portion of the housing, and fastening components for use in connecting the elements of the assembly together.
Figure 2B:
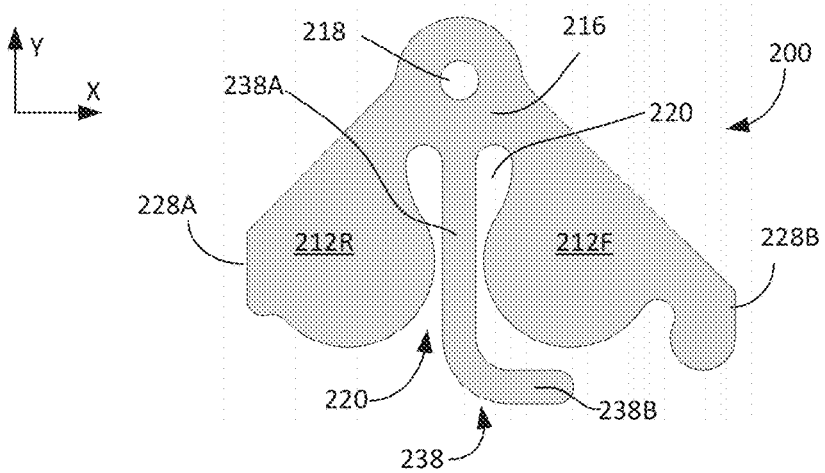
FIG. 2B schematically illustrates an embodiment of the brake pad of the device of FIG. 2A.

Details of the structure of one embodiment of the braking device 124, on the other hand, are presented in FIGS. 2A, 2B. Here, FIG. 2A illustrates, in perspective view, components of disassembled embodiment 124 showing the brake pad 200 and the housing 204 (shown to include two half-shells 204A, 204B that are connected with one another, in this case, with the fixator/fastener 208 to define an enclosed volume or interior of the housing 204). The housing 204 is dimensioned to enclose the brake pad 200 in its interior in a specific fashion discussed below, while FIG. 2B provides a plan view of one specifically-shaped embodiment of the brake pad 200.

The embodiment 200 of the brake pad is shown to include a brake plate 212 (with rear and front portions 212R, 212F of the brake plate that are interconnected with one another via a head portion (or bridge portion) 216 of the brake plate and that are mutually oriented to define a slit 220 between the portions 212R, 212F). The head or bridge portion 216 is shown to have a throughout aperture or opening 218, through which the fixator 208 (in this case, the through screw or bolt, appropriately cooperated with the corresponding nut and optionally washer, as shown) is passed to affix the brake pad 200 within the dedicated space afforded by the shell 204A prior to sandwiching the pad 200 between the half-shells 204A, 204B and closing the housing 204 with the pad 200 contained inside. As shown, the fixator 208 may be configured as an axle about which the pad 200—while outside of the housing 204—can swing or rotate in the plane of the pad 200 and along which the pad 200 can be repositioned when the housing 204 is not assembled yet. However, the housing shell 204A is dimensioned such that, when the pad 200 already cooperated with the fixator 208 is placed within or at the shell 204A, substantially any movement or motion of the brake pad 200 in the plane of the pad 200 (here, xy-plane) or in a direction transverse to the plane defined by the pad 200 is prevented. For example, the inner portions of the walls 224A, 224B of the housing shell 204A can be dimensioned such as to come substantially in contact with the outermost surfaces 228A, 228B of the brake plate. (In a related implementation, the housing shell 204A may be optionally dimensioned such that the inner portions of the walls 224A, 224B come substantially in contact with the outermost surfaces 228A, 228B of the brake plate while, at the same time, an inner surface 232 of the responding housing shell 204B is brought in contact with the back surface 236 of the pad 200.)

Figure 3C:
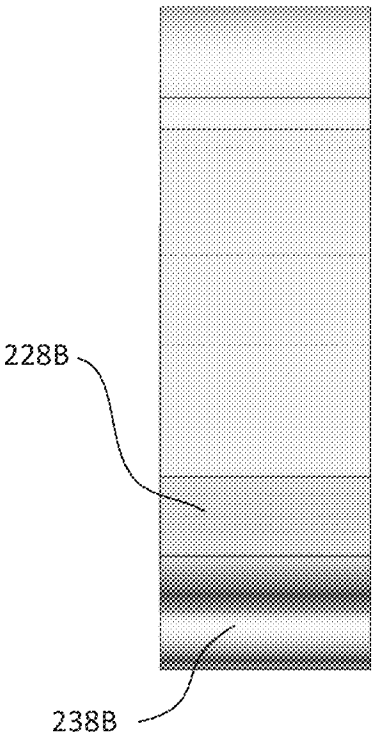
FIGS. 3A, 3B, 3C provide additional structural details of the embodiment of the brake pad of the automatic braking device.
Figure 3B:
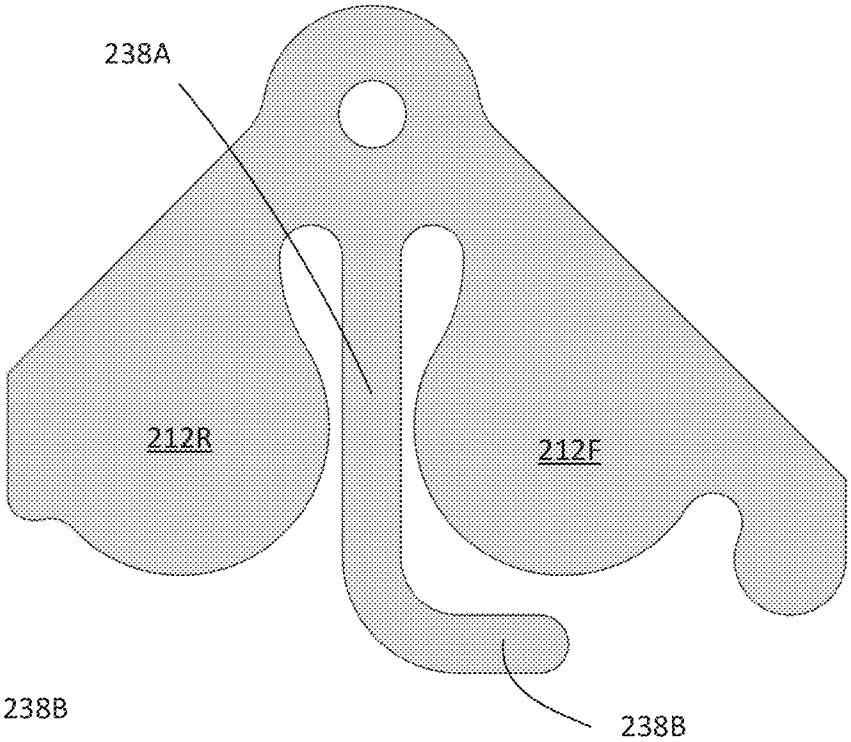
Figure 3A:
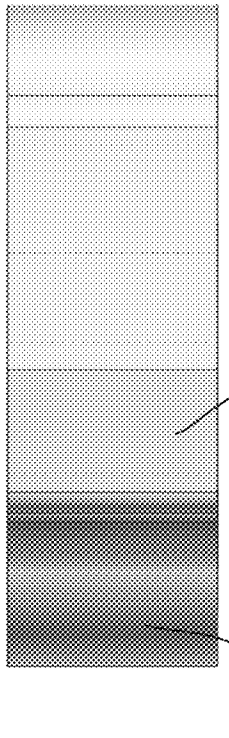

Referring now to FIG. 2B, the embodiment 200 of the brake pad additionally includes a brake tongue or brake leg 238 protruding from the brake plate (212R, 212F, 216) through the slit 220 such that the leg 238 and the brake plate lie in the same plane. The brake leg 238 includes at least a brake stalk 238A, extending from the head portion 216 through and along the slit 220 to have a free end of the stalk 238A located beyond outer perimeters of the portions 212R, 212F of the brake plate. In at least one implementation, however (as shown), the brake stalk 238A may be additionally complemented with a brake foot 238B that extends from the outer end of the stalk 238A along and outside the perimeter of the portion 212F in a direction of the front surface 228B of the brake pad 200. The housing 204 is judiciously dimensioned such as to not constrain, when put together—that is, to permit—repositioning of the brake leg 238 in the plane of the brake pad, at least within the bounds of the slit 220. FIGS. 3A,3B, and 3C that provide, respectively a rear view, a side view, and a front view of the embodiment 200 of the brake pad, illustrates some additional details of the brake pad structure. In operation of the embodiment of the automatic brake device 124 the outer end of the brake stalk 238A and/or the brake foot 238B is brought in frictional contact with an outer rim of the wheel of the manually-propelled vehicle once the device 124 is cooperated/mated with such vehicle, as discussed in detail below in reference to FIG. 5.

Referring again to FIGS. 2A, 2B, the inner portion 204B of the housing 204 may be structured to reserve some additional space 244 to accommodate the armrest partition 116 of the wheelchair. When the fixator 208 is configured as a screwed/threaded axle, dedicated passages 248, 252 (at least one of which may be a throughout passage) may be formed in the housing portions 204A, 204B to accommodate such axle. In the embodiment as shown, the axle 208 is used to threadingly secure with the use of a nut the half-shells 204A, 204B to one another once the brake pad 200 juxtaposed with the axle 208 with the use of the aperture 218 is inside the dedicated space of the half-shell 204A. In a related implementation, the nut may not be required as the passage accommodating the threaded end of the axle 208 in a corresponding one of the shells 204A, 204B may be threaded in a reciprocal fashion.

FIGS. 4A, 4B, 4C, 4D, 4E, 4F, 4G, and 4H provide such views of an embodiment of the automatic braking device that demonstrate the relationship of various components of the assembly of the device to each other and to the components of the manually-propelled vehicle with which such device is cooperated.

Figure 4B:
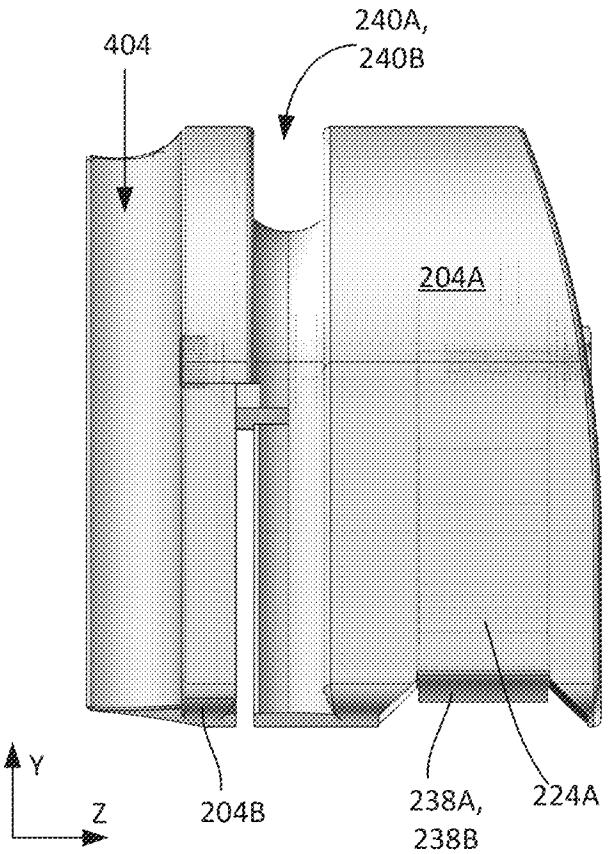
FIGS. 4A, 4B, 4C, 4D, 4E, 4F, 4G, and 4H are different views of the assembly of the embodiment of the automatic braking device and/or its constituent components.
Figure 4A:
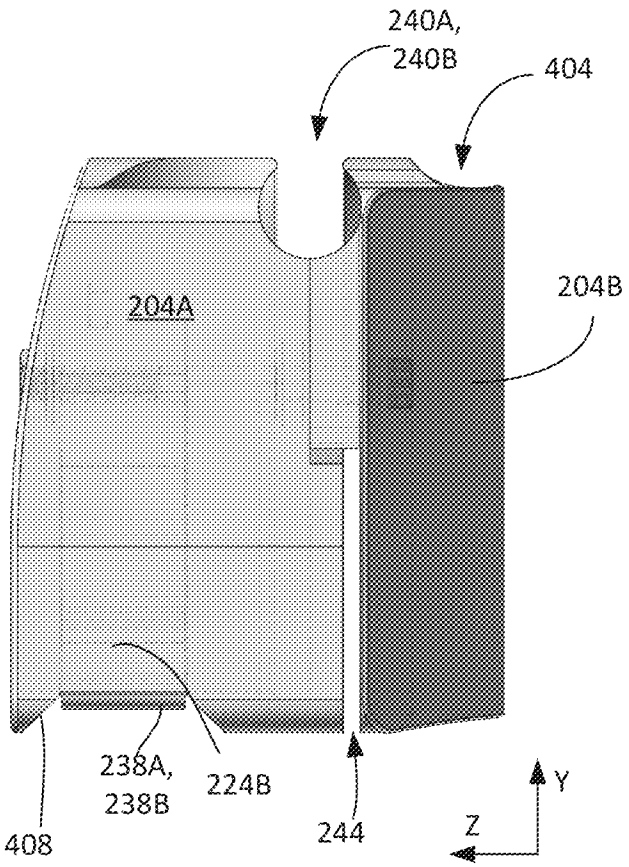
Figure 4C:
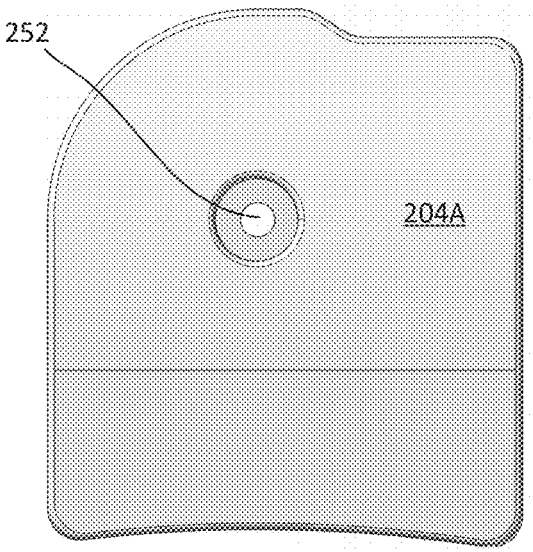
Figure 4D:
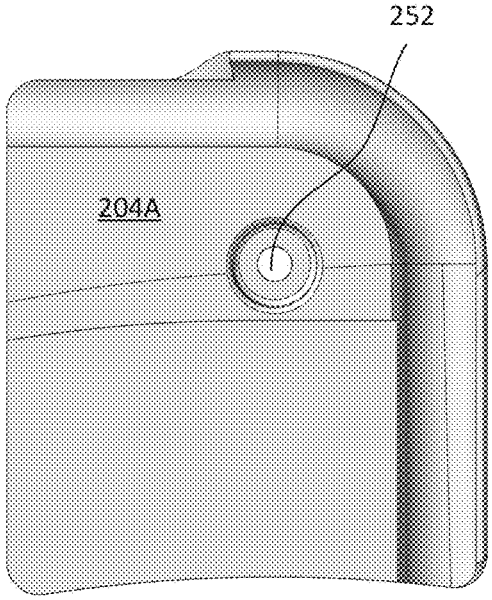
Figure 4E:
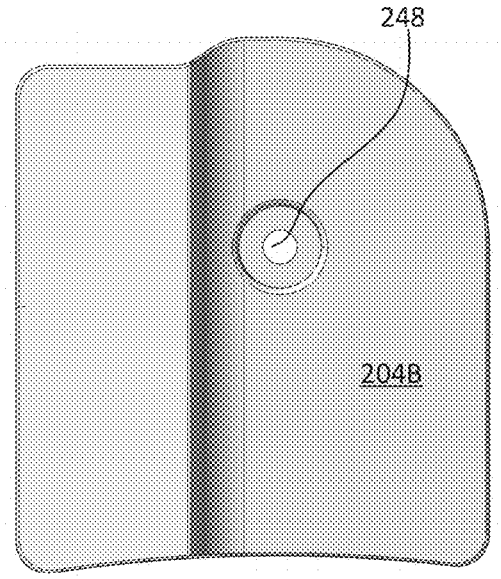
Figure 4F:
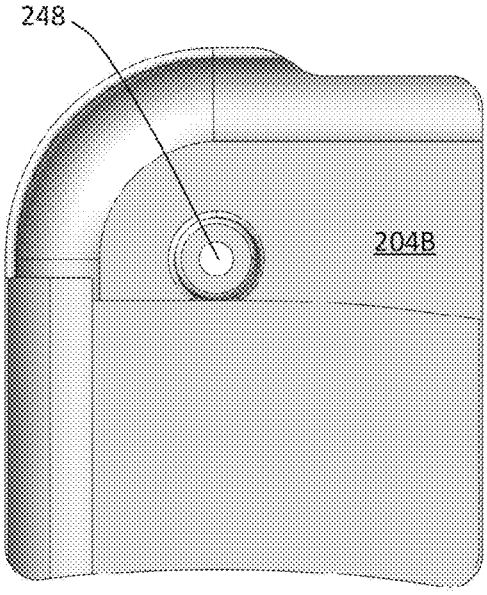
Figure 4H:
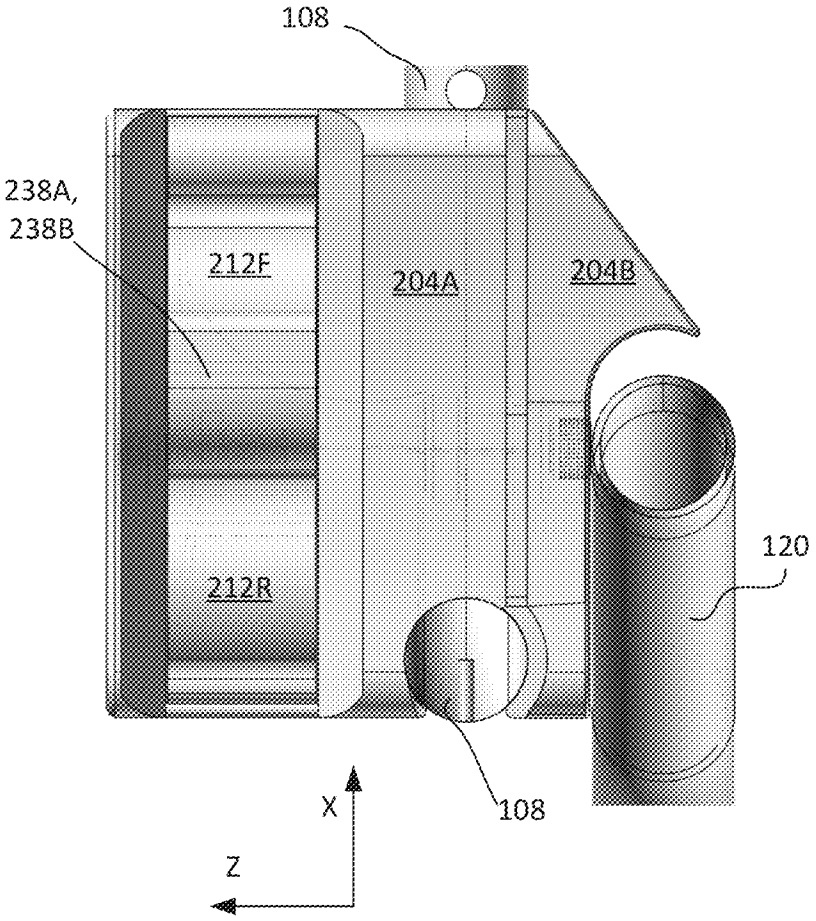
Figure 4G:
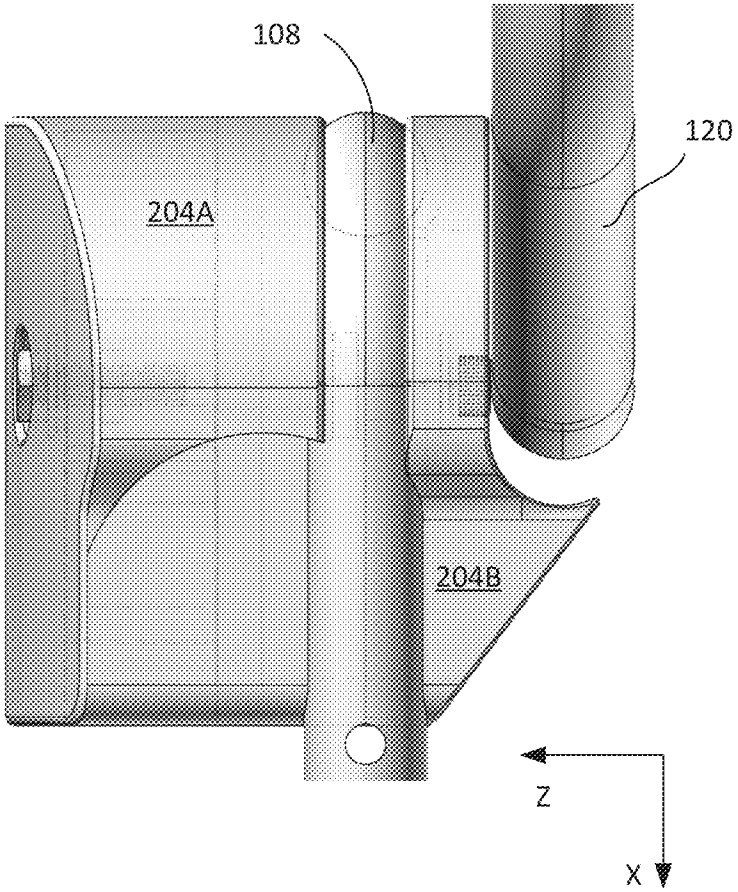

A completed assembly of the embodiment 124 is shown in front view in FIG. 4A and in back view in FIG. 4B. Referring to FIGS. 4A, 4B and further referring to the schematic of FIG. 2A of the disassembled device 124, the reciprocating housing portions (half-shells) 204A, 204B can be structured in at least one case to include, respectively, grooves 240A, 240B (formed, for example, by molding when the housing 204 is made of a moldable material such as plastic) to accommodate the upper portion of the anterior rail 108 of the a standard wheelchair and/or a groove 404 can be additionally dimensioned in the back portion of the housing 204 to accommodate the hand rail 120 of the standard wheelchair. The outer end of the stalk 238A and/or the foot 238B can be seen protruding through the opening in the bottom of the housing 204. The additional space 244 is dimensioned to accommodate the wheelchair armrest partition 116. A dedicated bevel 408 can be optionally formed on the outer half-shell 204A portion of the housing 204 to facilitate centering of the outer end of the brake stalk 238A and/or the brake foot 238B of the brake pad 200 and help minimize possible pinch points. FIG. 4C is a side view of the outer half-shell 204A of the housing 204 as seen from outside, in the −z direction; FIG. 4D is a view of the interior of the half-shell 204A as seen along the +z axis; FIG. 4E is a view of the inner half-shell 204B of the housing 204 as seen in the −z direction, while FIG. 4F provides a view of the half-shell 204B along the +z axis. FIGS. 4G and 4H illustrate, respectively, portions of the embodiment 100 with which an embodiment of the automatic brake device 124 is cooperated, in top and bottom views, respectively.

Overall, the front and back housing shells 204A, 204B form a space or a volume therebetween dimensioned to accommodate the embodiment of the brake pad and dimensioned such as to permit repositioning of the leg of the brake pad in the plane of the brake pad between side walls of the housing structure and/or spatially limit such repositioning at at least a portion of a side wall of the side walls of the housing structure. When reversibly assembled together with the brake pad secured in-between, the housing shells 204A, 204B define a housing structure that has a top portion and a bottom opening or aperture between the shells opposite the top portion, while the leg of the brake pad extends from the head portion (affixed at the top portion of the housing structure between the housing shells) towards such bottom opening or aperture.

Figure 5C:
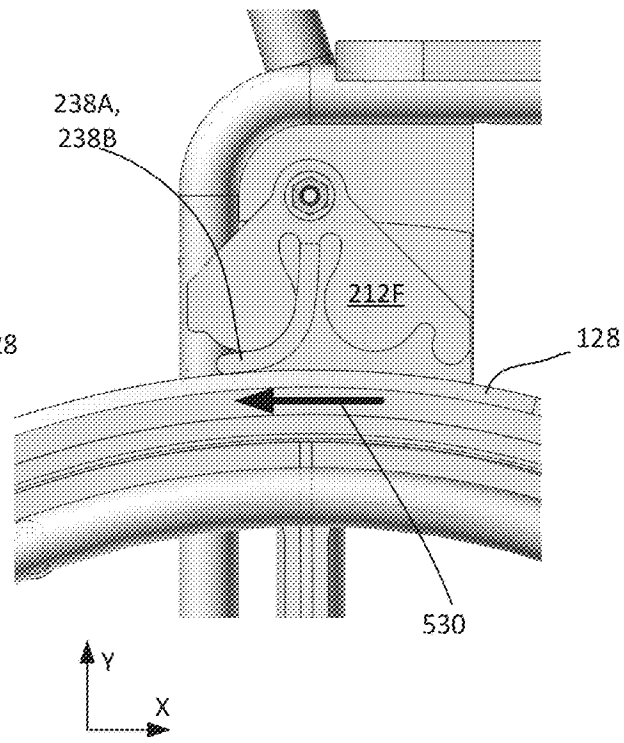
FIGS. 5A, 5B, and 5C illustrate the principle of operation of an embodiment of the device.
Figure 5B:
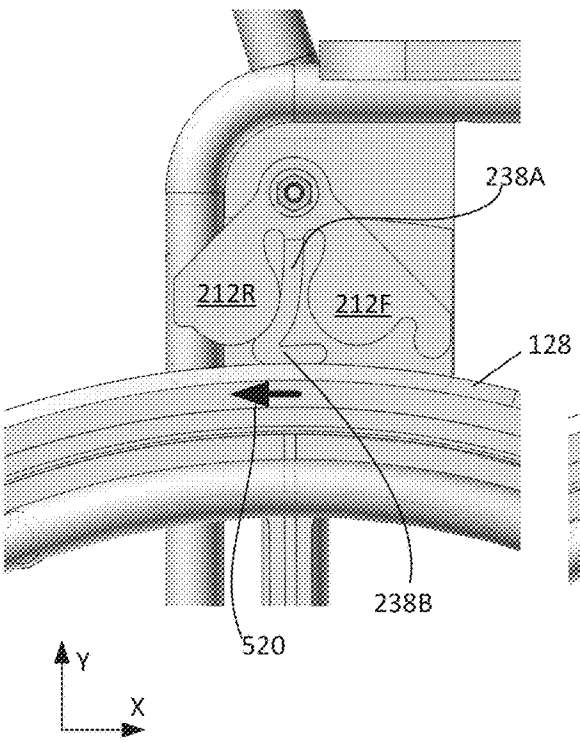
Figure 5A:
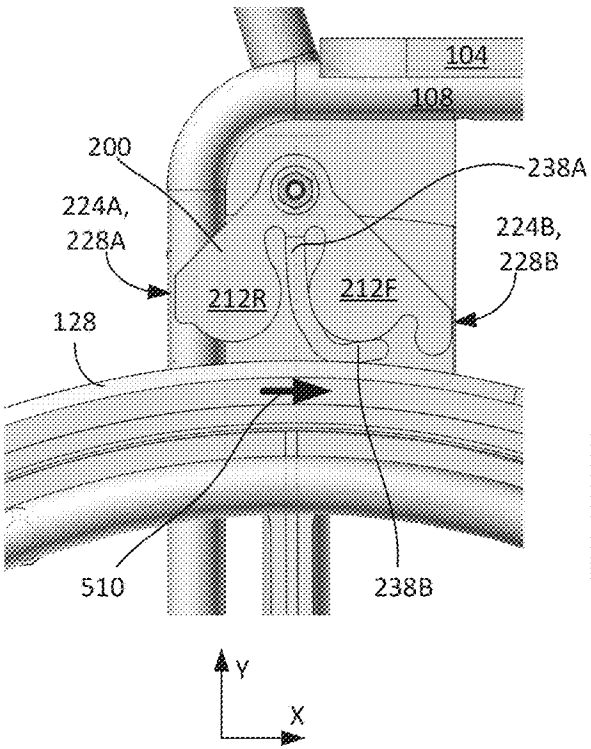

Having the advantage of the above-presented disclosure, the skilled person will now readily appreciate the principle of operation of the above-discussed embodiment of the invention in reference to FIGS. 5A through 5C. Each of FIGS. 5A, 5B, and 5C illustrates the embodiment of the automatic brake device 124 cooperated with the vehicle 100 (with the outer half-shell assumed to be transparent, to be able to see through it and perceive the brake pad 200) to understand the operation of the device 124. Specifically, FIG. 5A illustrates the situation when the wheel of the vehicle 100 is rotated forward (as indicated with an arrow 510), during which rotation friction between the outer end of the brake stalk 238A and/or the brake foot 238B that have been brought into such contact with the outer rim of the wheel 128 as a result of the process of structural cooperation of the device 124 with the vehicle 100 (see FIG. 1) remains at a substantially non-zero level. During the forward rotation of the wheel 128, the stalk 238A is deformed as compared to its stationary state (shown in FIG. 2B) and/or deviated and/or bent within the limits of the slit 220 while its outer and and/or foot 238B are extended forwardly and outside of the outer perimeter of the brake plate (here, outside of the perimeter of the portion 212F).

As shown in FIG. 5B, when the user of the vehicle (who may be sitting in the chair of the vehicle) attempts to stand up and leave the vehicle 100, thereby inadvertently pushing the vehicle backwards, or when the vehicle 100 simple rolls backwards, arrow 520, with a momentum that causes the friction between the stalk 238A and/or the foot 238B and the outer rim of the wheel 128 not exceeding the level of the statis friction, the brake leg 238 (specifically, the brake foot 238B) simply deforms in the opposite direction, towards the portion 212R of the brake pad 200 such as to reposition at least the brake foot in the backward direction thereby increasing the level of friction with the wheel and at least slowing the backward rotation of the wheel or even stopping such rotation. This situation occurs with any minor attempt of the manually propelled vehicle to go in reverse. It is in this reconfiguration, that the operation of the device 124 will prevent the unoccupied wheelchair or manually propelled vehicle from rolling backwards.

FIG. 5C illustrates the situation when the wheel 128 is rotated in the backward direction with a momentum exceeding a threshold momentum (as shown by arrow 530). Here, the brake leg 238 (specifically, the brake foot 238B) is flexed in the backward direction and remains in continued frictional contact with the wheel 128 while, at the same time, not preventing the wheel from continued rotation in the backward direction. It is understood that, after the brake foot has been flexed in the backward direction by corresponding rotation of the wheel, the rotation of the wheel can be again changed to a rotation in the forward direction, as a result of which the brake foot 239B is flexed now in the forward direction and at least the brake stalk 238A of the brake leg 238 is moved in the forward direction to again maintain the level of friction with the outer rim of the wheel below the level of static friction such as to permit a rotation of the wheel in the forward direction without being stopped.

The skilled person will readily appreciate that an embodiment of the braking mechanism can be appropriately modified and/or simplified without deviating from the idea of the invention. One possible modification is schematically illustrated—in different perspective views—in FIGS. 6A, 6B. Here, the embodiment of the mechanism is configured to accommodate a simplified (as compared with the element 200 of FIGS. 2A, 2B) version of the brake pad 600, which in this case is configured as a "tongue-shaped" or "leg-shaped" plate of generally elastic material defining a plane of the brake pad (which, in this illustration, is substantially parallel to the xy-plane of the local coordinates system) and having a head portion 616 of the brake pad and a brake leg 638 extending from the head portion 616. During the assembly of the braking mechanism of FIGS. 6A, 6B, the brake pad 600, possessing an opening 618 throughout the head portion 616 (visible in FIG. 6B), is reversibly hung onto the shaft 644 that extends along the local z-axis, as shown, from the half-shell 604B of the housing 604 towards the other half-shell 604A and that contains another dedicated passage 648 therethrough (dimensioned by analogy with the passage 248 of FIG. 2A to accommodate the fastener 208, used to secure the half-shells 604A, 604B together to form a complete housing 604 that at least partially covers the brake pad 600 with such housing).

Figure 6A:
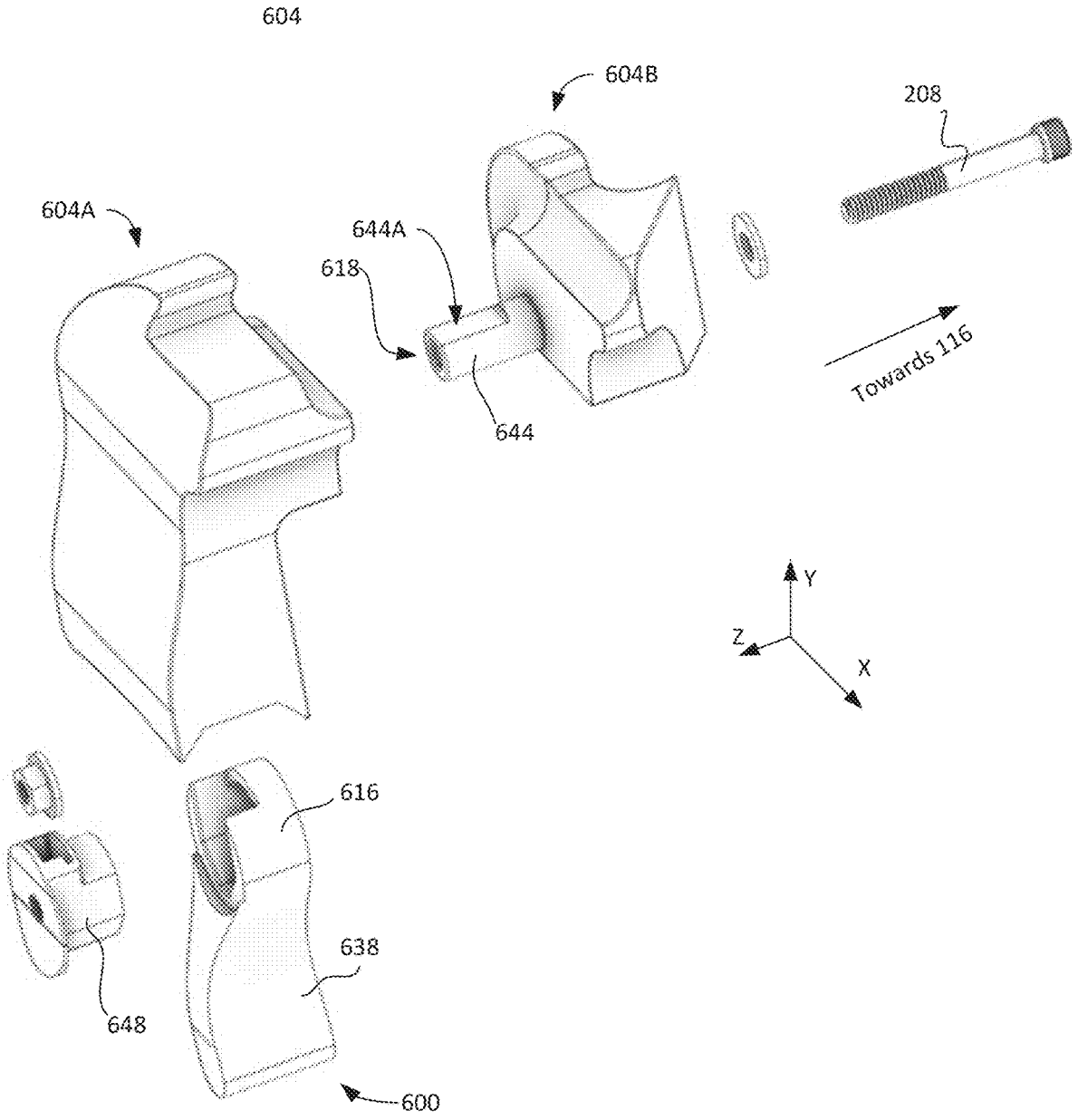
FIGS. 6A, 6B are exploded views of a related embodiment of a braking mechanism assembly showing its constituent parts, not necessarily in order, including an outer portion of the housing, a forward-facing flexible brake pad, an inner portion of the housing, and fastening components for use in connecting the elements of the assembly together.
Figure 6B:
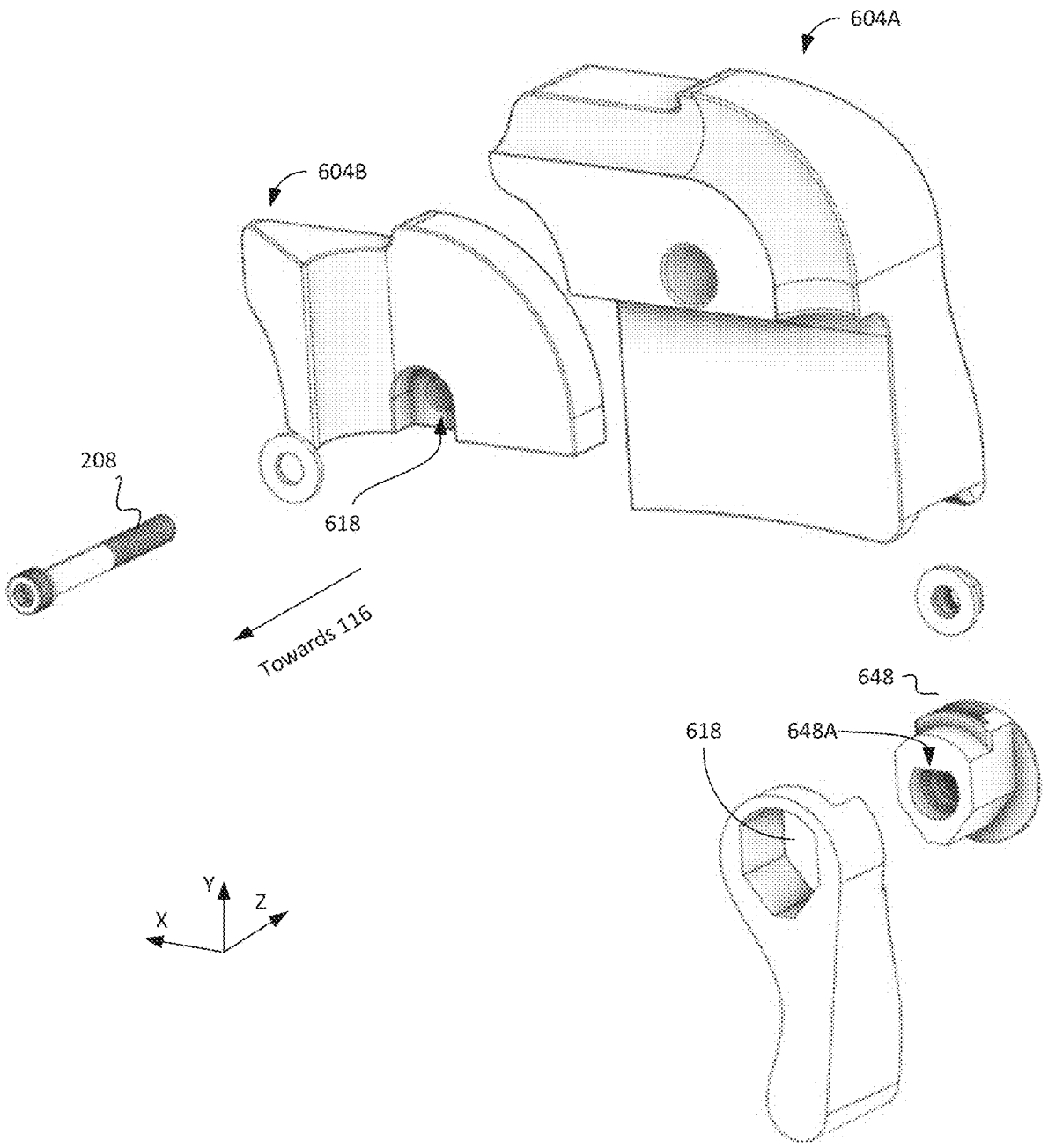

The washer 648 (preferably manufactured from resilient material, such as metal, that is different from the elastic material of the brake pad 600) may be additionally employed and secured with a nut. In at least one specific case, the internal walls of the opening 618 throughout the head portion 616 of the pad 600 and the outer surface of the washer 648 may be spatially complementarily dimensioned in a judicious fashion to dimensionally fit and match each other, each defining at least one dihedral angle, as illustrated in FIG. 6A, 6B. Such configuration ensures that upon mating the washer 648 with the head portion 616 at least a portion of the washer is substantially inserted into the opening 618 to prevent mutual rotational (about the axis of the shaft 644) repositioning of the washer 648 and the brake pad 600. Additionally or in the alternative, in at least one non-limiting case the shaft 644 can be dimensioned to be appropriately beveled (see 644A) along at least a portion of the length of the shaft 644 while the opening in the washer 648 may be limited with a surface 648A that is dimensionally complementary to the bevel 644A, thereby substantially preventing (in the assembled form of the brake mechanism) a possible rotational movement of the washer 648 and/or the pad 600 with respect to the shaft 644.

Notably—and considering optionally different vertical (along the y-axis) extents of the housing shells 204A, 204B—this related embodiment of the braking mechanism, when assembled and appropriately cooperated with the arm-rest 104 and/or the partition 116 of the manually-propelled vehicle (by analogy with the assembly illustrated in FIG. 1), may not necessarily completely enclose the leg of the brake pad 600 between the shells of the housing 604, but may rather provide a protection for the leg of the brake pad 600 at least in the space between the front housing shell 604A and the partition 116. In a related implementation—when the vertical extents of the shells 604A, 604B are substantially equal (by analogy with those of the embodiment of FIG. 2A), the front and back housing shells 604A, 604B form a volume therebetween dimensioned to accommodate the embodiment of the brake pad and dimensioned such as to permit repositioning of the leg of the brake pad in the plane of the brake pad between side walls of the housing structure and/or spatially limit said repositioning at at least a portion of a side wall of the side walls of the housing structure. In this case, when reversibly assembled together with the brake pad secured in-between, the housing shells 604A, 604B define a housing structure that has a top portion and a bottom output opening or aperture between the shells opposite the top portion, while the leg of the brake pad extends from the head portion (affixed at the top portion of the housing structure between the housing shells) towards such bottom output opening or aperture.

Figure 7:
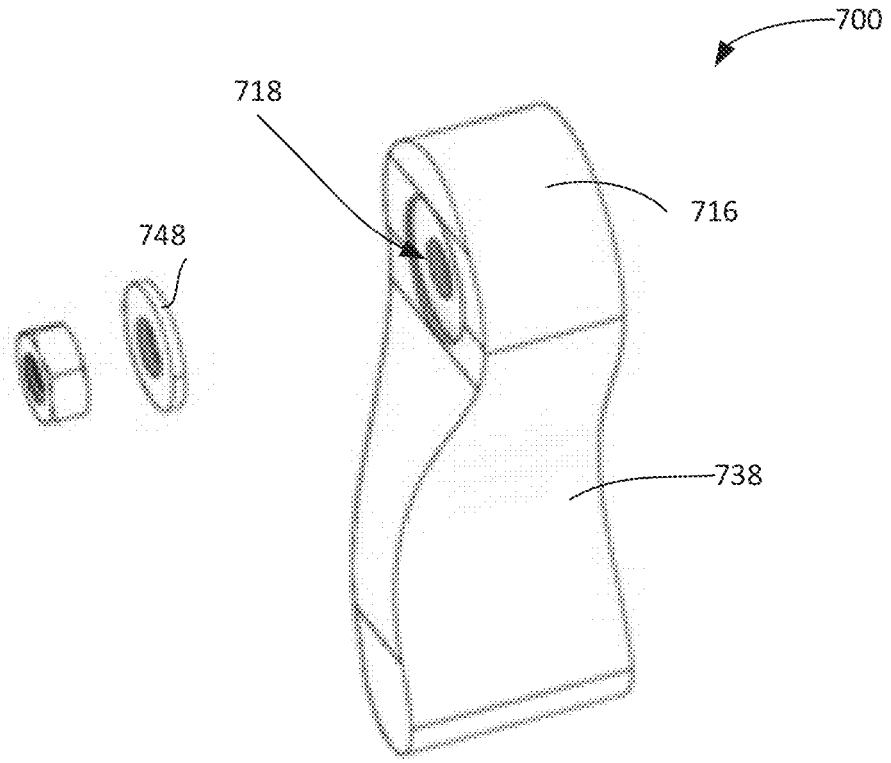
FIG. 7 schematically illustrates yet another related embodiment of the brake pad.

In yet another, simpler implementation of the brake pad—see FIG. 7—the opening 718 formed throughout the head portion 716 of embodiment 700 of the brake pad may be substantially devoid of (not contain) any specific internal shape characterized by dihedral angle(s). The optional washer 748—if and when used—is not required to have any specific structural features in this case and may be structured as an annular ring-like plate of substantially constant thickness. The embodiment of the brake pad 700 can be configured as a plate of (generally but optionally elastic) material the thickness of the leg portion 738 of which may be optionally made different from the thickness of the head portion 716.

Figures 8A, 8B, 8C:
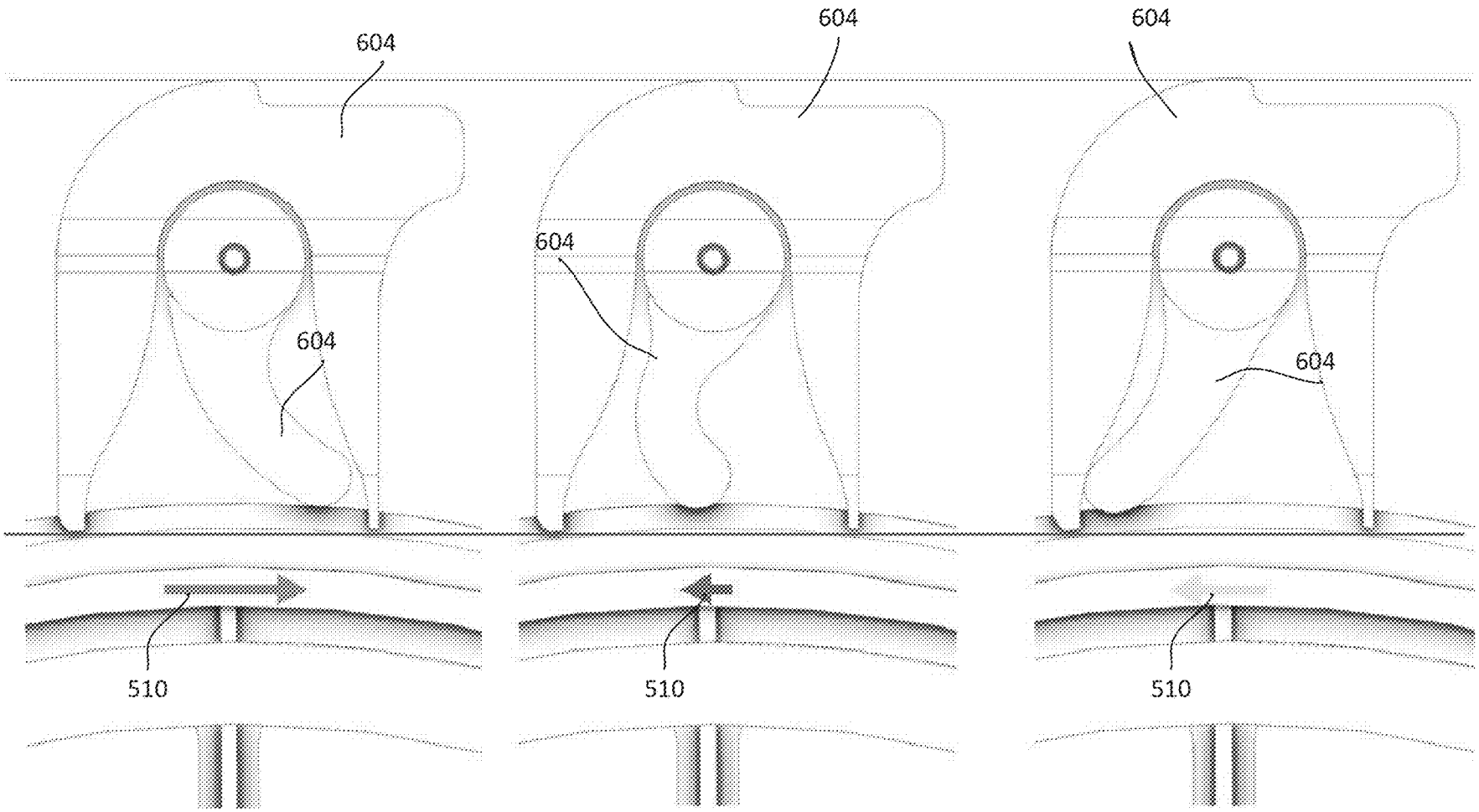
FIGS. 8A, 8B, and 8C schematically depict the principle of operation of the embodiments of FIGS. 6A, 6B and FIG. 7.

FIGS. 8A, 8B, and 8C schematically illustrate the operation of the embodiment of the braking device of FIGS. 6A, 6B, removably attached to the frame and/or arm-rest partition portion of a manually-propelled vehicle. Here, by analogy with the operation of another embodiment depicted in FIGS. 5A through 5C and having cooperated the embodiment of the braking device with a wheel of the manually-propelled vehicle such that an outer surface of the brake leg is in frictional contact with an outer portion of the wheel regardless of whether the wheel is rotated in a forward direction or in a backward direction, the engagement of the braking device depends on the direction of rotation of the wheel. Specifically, when the wheel is rotated in the forward direction, a level of friction between the brake leg and the outer portion of the wheel is kept below a level of static friction as a result of having the brake leg repositioned in the forward direction (FIG. 8A). When the wheel is rotated in backward direction (FIGS. 8B, 8C), the level of friction between the brake leg and the outer portion of the wheel is increased as a result of having the brake leg repositioned in the backward direction. The increase of level of friction includes elevating the level of friction to the level of static friction, as understood in the art, to substantially prevent a rotation of the wheel in the backward direction (FIG. 8B). At the same time, when the wheel is rotated in the backward direction with a momentum exceeding a threshold momentum (FIG. 8C), the brake leg is reversibly flexed in the backward direction while at the same time not preventing the wheel from continued rotation in the backward direction. Notably, after the brake leg has been flexed in the backward direction by corresponding rotation of the wheel, the rotation of the wheel can be and is, if so desired, reversed—that is, changed again to the rotation of the forward direction while, at the same time, flexing the brake leg in the forward direction and moving at least a stock of the brake leg in the forward direction to again keep the level of friction below the level of static friction and to permit a substantially uninhibited rotation of the wheel in the forward direction.

The skilled artisan can now appreciate that embodiments of the invention provide an article of manufacture that includes at least a braking device and/or a manually-propelled vehicle equipped with such braking device. The braking device includes at least a housing structure (generally reversibly assembled from a front housing shell and a back housing shell) to define a space covered by the housing structure. The housing structure includes a top portion and a bottom opening between the front housing shell and the back housing shell (which bottom opening is opposite the top portion). The braking device includes a brake pad defining a plane of the brake pad and including a head portion of the brake pad and a brake leg extending therefrom. The head portion of the brake pad is configured to be reversibly affixed in the space at the top portion of the housing structure with the brake leg extending throughout the volume towards the bottom opening.

While the idea of the invention is described through the above-described examples of embodiments, it will be understood by those of ordinary skill in the art that modifications to, and variations of, the illustrated embodiments may be made without departing from the inventive concepts disclosed herein. For example, the affixation of the embodiment of the brake pad 200, 600 within the housing 204, 604 does not have to be necessarily facilitated with the use of an axle such as a fastener/fixator 208, 608 but may be, instead, carried out by the appropriate shaping of the head portion 216, 616 and shaping an inner surface of the housing 204, 604 such as to snappingly affix the bridge portion therein. Disclosed aspects, or portions of these aspects, may be combined in ways not listed above. Accordingly, the invention should not be viewed as being limited to the disclosed embodiment(s).

Examples of materials for use in fabrication of the brake pad include rubber and/or some sort of a known elastomeric compound-based material. The housing structure, discussed below, which at least partially encloses and supports the brake pad, is preferably made of material that is strong, lightweight, and inflexible—at least in reference to the material of the brake pad—such as for example plastic, carbon fiber, even aluminum, to name just a few. As the skilled person will now readily appreciate, the ranges of dimensions of embodiments of the invention are chosen to successfully cooperate such embodiments with the chosen type of a manually-propelled vehicle. Using the wheelchair Invacare Tracer EX 2 as an example, the footprint of a side of the housing structure supporting the brake pad is about 3.5 by 4 inches or smaller, while the footprint of the brake pad in implementation discussed in reference to FIGS. 6A, 6B, for example, preferably fits within a rectangle of about 1 1/8 by 3 inches.

For the purposes of this disclosure and the appended claims, the expression of the type "element A and/or element B" has the meaning that covers embodiments having element A alone, element B alone, or elements A and B taken together and, as such, is intended to be equivalent to "at least one of element A and element B".

References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment,"and similar language throughout this specification may, but do not necessarily, all refer to the same embodiment. It is to be understood that no portion of disclosure, taken on its own and in possible connection with a figure, is intended to provide a complete description of all features of the invention. Within this specification, embodiments have been described in a way that enables a clear and concise specification to be written, but it is intended and will be appreciated that embodiments may be variously combined or separated without parting from the scope of the invention. In particular, it will be appreciated that all features described herein are applicable to all aspects of the invention.

When the present disclosure describes features of embodiments of the invention with reference to corresponding drawings (in which like numbers represent the same or similar elements, wherever possible), the depicted structural elements are generally not to scale, and certain components may be enlarged or reduced in size relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, at least for purposes of simplifying the given drawing and discussion, and directing the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this particular detail in the drawing may be implied unless the context of the description requires otherwise. In other instances, well known structures, details, materials, or operations may be not shown in a given drawing or described in detail to avoid obscuring aspects of an embodiment of the invention that are being discussed. Furthermore, the described single features, structures, or characteristics of the invention may be combined in any suitable manner in one or more further embodiments.

For the purposes of this disclosure and the appended claims, the use of the terms "substantially", "approximately", "about" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "essentially", "to great or significant extent", "largely but not necessarily wholly the same" such as to reasonably denote language of approximation and describe the specified characteristic or descriptor so that its scope would be understood by a person of ordinary skill in the art. The use of this term in describing a chosen characteristic or concept neither implies nor provides any basis for indefiniteness and for adding a numerical limitation to the specified characteristic or descriptor. As understood by a skilled artisan, the practical deviation of the exact value or characteristic of such value, element, or property from that stated may vary within a range defined by an experimental measurement error that is typical when using a measurement method accepted in the art for such purposes. As an example only, a reference to a vector or line or plane being substantially parallel to a reference line or plane is to be construed as such vector or line extending along a direction or axis that is the same as or very close to that of the reference line or plane (with angular deviations from the reference direction or axis that are considered to be practically typical in the art, for example between zero and fifteen degrees, more preferably between zero and ten degrees, even more preferably between zero and 5 degrees, and most preferably between zero and 2 degrees). A term "substantially flexible", when used in reference to a housing or structural element providing mechanical support for a contraption in question, generally identifies the structural element the flexibility of which is higher than that of the contraption that such structural element is associated with. As another example, the use of the term "substantially flat" in reference to the specified surface implies that such surface may possess a degree of non-flatness and/or roughness that is sized and expressed as commonly understood by a skilled artisan in the specific situation at hand. For example, the terms "approximately" and about", when used in reference to a numerical value, represent a range of plus or minus 20% with respect to the specified value, more preferably plus or minus 10%, even more preferably plus or minus 5%, most preferably plus or minus 2%.

The invention as recited in claims appended to this disclosure is intended to be assessed in light of the disclosure as a whole, including features disclosed in prior art to which reference is made.

The invention claimed is:

1. An article of manufacture comprising:

an automatic braking device that includes:

a housing structure including a front housing shell and a back housing shell configured to be reversibly assembleable together to define a space of the housing structure, the housing structure having a top portion and a bottom opening between the front housing shell and the back housing shell opposite the top portion; and a brake pad having a substantially planar surface that defines a plane of the brake pad and including a head portion of the brake pad and a brake leg extending therefrom, wherein the head portion of the brake pad is configured to be reversibly affixed inside the space at the top portion to the housing structure with the brake leg extending throughout the space towards the bottom opening.

2. An article of manufacture according to claim 1, (2A) wherein the housing structure is dimensioned to permit repositioning of the brake leg in the plane of the brake pad between side walls of the housing structure and/or spatially limit said repositioning at at least a portion of a side wall of the side walls of the housing structure; and/or (2B) wherein, the housing structure is dimensioned to define, in an assembled state, a volume substantially enclosed by the front and back housing shells, said volume having access thereto through said bottom opening.

3. An article of manufacture according to claim 1, (3A) wherein the head portion of the brake pad has an opening throughout the head portion and the housing structure contains or is complemented with a shaft or axle that is fitted into and/or through the opening when the brake pad and the housing structure are assembled together; and/or (3B) wherein said opening throughout the head portion of the brake pad is not a substantially cylindrical opening and has an internal surface, the article of manufacture further comprising a washer having an outer surface of the washer that is substantially dimensionally complementary to the internal surface of the opening throughout the head portion of the brake pad; and/or (3C) wherein said internal surface of the opening throughout the head portion of the brake pad is dimensioned to form at least one dihedral angle; and/or (3D) wherein the washer includes a washer portion containing said outer surface of the washer, said washer portion being dimensioned to be received within said opening throughout the head portion of the brake pad to substantially prevent mutual rotation between the brake pad and the washer about the axis of said opening when the washer portion is inserted in said opening; and/or (3E) wherein said shaft or axle is integrated with a housing shell of the front and back housing shells.

4. An article of manufacture according to claim 1, wherein the brake pad includes a brake plate with a slit, wherein the brake leg extends from the head portion through the slit to form a protrusion outside a perimeter of the brake plate such that the brake plate and the brake leg lie in the plane of the brake pad;

wherein the housing structure is dimensioned to substantially prevent repositioning of the brake plate both in the plane of the brake pad and in a direction transverse to the plane of the brake pad.

5. An article of manufacture according to claim 4, wherein the brake leg further includes a brake foot at an end of a stalk of the brake leg, the brake foot extending substantially transversely to the stalk.

6. An article of manufacture according to claim 1, dimensioned to have an outer surface of the brake pad to be substantially in contact with an outer perimeter of a wheel of a manually-propelled vehicle when the device is cooperated with said wheel while the plane of the brake pad is substantially parallel to a plane of the wheel.

7. An article of manufacture according to claim 6, wherein the brake pad is configured to have an end of the brake leg to remain in frictional contact with the wheel while not preventing a rotation of the wheel when the wheel is rotated in a forward direction.

8. An article of manufacture according to claim 6, wherein the brake pad is configured to have the brake leg to at least compress such as to change a shape of the brake leg and increase frictional contact between an end of the brake leg and the wheel when the wheel is rotated in a backward direction.

9. An article of manufacture according to claim 6, wherein the brake pad is configured to have the brake leg reversibly flex in the backward direction when a momentum of rotation of the wheel in said backward direction exceeds a threshold value while, at the same time, to have the brake leg flex in the forward direction when a direction of the rotation of the wheel in changed from the backward direction to the forward direction.

10. An article of manufacture according to claim 6, wherein the automatic braking device is:

(10A) devoid of a part controlling a movement of the brake pad; and/or (10B) devoid of a brake rotor; and/or (10C) devoid of a component configured to reposition the brake pad along a radius of the wheel after the device has been connected to the wheel.

11. An article of manufacture according to claim 1, (11A) devoid of a part controlling a movement of the brake pad; and/or (11B) devoid of a brake rotor.

12. An article of manufacture according to claim 1, further comprising a manually-propelled vehicle structured to be cooperated with said automatic braking device such as to have the bottom opening of the housing structure face an outer surface of a wheel of the vehicle while the brake pad is in frictional contact with said outer surface.

13. An article of manufacture according to claim 12, wherein the braking device is devoid of a component configured to reposition the brake pad along a radius of the wheel after the device has been connected to the wheel.

14. An article of manufacture according to claim 12, wherein said manually-propelled vehicle is a wheelchair and/or a wheeled walker, and/or wherein said manually-propelled vehicle is configured to be foldable for unimpeded movement or storage.

15. An article of manufacture according to claim 12, wherein the automatic braking device is configured to be reversibly affixable to a portion of a frame of the manually-propelled vehicle that supports an arm-rest thereof and/or to an arm-rest partition of the vehicle, and wherein (i) said portion of the frame and/or said arm-rest partition, and/or (ii) said automatic braking device is configured to be at least reversibly repositionable with respect to a wheel of the vehicle while the automatic braking device is affixed to said portion of the frame and/or said arm-rest partition, with the brake leg in frictional contact with an outer portion of the wheel, to reversibly disconnect the brake leg from said outer portion.

16. A method comprising:

cooperating a braking device according to claim 1 with a wheel of a manually-propelled vehicle such that an outer surface of the brake leg remains in frictional contact with an outer portion of the wheel regardless of whether the wheel is rotated in a forward direction or in a backward direction;

when the wheel is rotated in the forward direction, keeping a level of friction between the brake leg and the outer portion of the wheel below a level of static friction by having the brake leg repositioned in the forward direction; and when the wheel is rotated in backward direction, increasing said level of friction by having the brake leg repositioned in the backward direction.

17. A method according to claim 16, wherein the increasing said level of friction includes increasing said level of friction to the level of static friction, thereby substantially preventing a rotation of the wheel in the backward direction.

18. A method according to claim 17, devoid of obstructing, by the automatic braking device, of an ability of the occupant to operate the vehicle; and/or devoid of obstructing, by the automatic braking device, of an ability of the occupant to remove and/or replace an armrest of the wheelchair required for said occupant's rising from and/or egressing the vehicle.

19. A method according to claim 16, further comprising, when the wheel is rotated in the backward direction with a momentum exceeding a threshold momentum, reversibly flexing the brake leg in the backward direction while not preventing the wheel from continued rotation in the backward direction.

20. A method according to claim 19, further comprising, after the brake leg has been flexed in the backward direction by corresponding rotation of the wheel, changing the rotation of the wheel to a rotation of the forward direction while, at the same time, flexing the brake leg in the forward direction and moving at least a stalk of the brake leg in the forward direction to again keep said level of friction below the level of static friction and to permit a substantially uninhibited rotation of the wheel in the forward direction.

21. A method according to claim 16, wherein the manually-propelled vehicle is a wheelchair, and further comprising rolling back the manually-propelled vehicle when an occupant of the vehicle rises from and/or egresses the vehicle.

22. A method according to claim 16, wherein said cooperating includes connecting a first braking device according to claim 1 to a first wheel of the manually-propelled vehicle and connecting a second braking device according to claim 1 to a second wheel of said vehicle.

23. A method according to claim 16, wherein said cooperating includes reversibly affixing the automatic braking device to a portion of a frame of the manually-propelled vehicle that supports an armrest thereof and/or to an armrest partition of the vehicle, and further comprising:

reversibly repositioning (i) said portion of the frame and/or said armrest partition and/or (ii) said automatic braking device with respect to the wheel of the vehicle while the automatic braking device is affixed to said portion of the frame and/or said arm-rest partition to reversibly disconnect the brake leg from being in frictional contact with said outer portion of the wheel.

* * * * *